United States Patent [19]

Geberth, Jr.

[11] 4,126,272

[45] Nov. 21, 1978

[54] ADJUSTABLE SPRAY TIP

[76] Inventor: John D. Geberth, Jr., Rifle Camp Rd., W. Paterson, N.J. 07424

[21] Appl. No.: 659,755

[22] Filed: Feb. 20, 1976

[51] Int. Cl.[2] ..... B05B 1/32

[52] U.S. Cl. ..... 239/455; 239/586

[58] Field of Search ..... 239/586, 455, 569, 581; 251/205, 215

[56] References Cited

U.S. PATENT DOCUMENTS

| | | | |
|---|---|---|---|
| 1,002,960 | 9/1911 | Berry | 239/455 |
| 2,968,919 | 1/1961 | Hughes et al. | 239/586 X |
| 3,468,482 | 9/1969 | Lindner et al. | 239/586 X |
| 3,667,681 | 6/1972 | Blancha | 239/393 |

FOREIGN PATENT DOCUMENTS

| | | | |
|---|---|---|---|
| 269,543 | 3/1967 | Fed. Rep. of Germany | 239/230 |

*Primary Examiner*—Joseph F. Peters, Jr.
*Assistant Examiner*—Michael Mar
*Attorney, Agent, or Firm*—Joseph J. Orlando

[57] ABSTRACT

An improved adjustable spray tip or nozzle is provided for spray guns and like devices which are adapted to hydraulically atomize and spray liquids such as paint. The spray tip includes an adjustable valve stem which varies, by means of adjustment, the spray opening and thus the fan spray issuing from the spray tip.

12 Claims, 7 Drawing Figures

ADJUSTABLE SPRAY TIP

The present invention relates generally to spray guns and like devices for hydraulically atomizing and spraying liquids such as paint and, more particularly, it relates to such a device having a novel and improved spray tip and improvements therein which permits adjustment of the fan spray issuing from the spray opening.

In my earlier filed application, now U.S. Pat. No. 3,936,002, granted Feb. 3, 1976, I have described such a novel and improved spray tip wherein the adjustable spray tip body is mounted to a hydraulic spray gun for communication with the fluid passageway extending through the spray gun. The adjustable spray tip body includes a valve bore extending partially therethrough, a groove formed in the spray tip body intersecting the valve bore thereby forming a spray or nozzle opening, and a fluid bore in the spray tip body providing communication between the valve bore and the fluid passageway of the spray gun, thus permitting pressurized liquid to be transferred through the spray gun to the valve bore to be exited through the nozzle opening. For the purpose of adjusting the fan spray issuing from the nozzle opening, I have therein described the provision of a valve stem attached to an adjustment knob and which is moveable in the valve bore to thereby vary the nozzle opening and in turn the fan spray issuing therefrom. The present invention, more particularly described hereinafter, is concerned with just such a novel and improved spray tip and incorporates therein certain improvements which I have developed and discovered to be useful and advantageous in the operation thereof.

A major problem encountered with the adjustable spray tip according to the design described in my copending application referred to above concerns the inadvertent dropping of the spray tip whether or not attached to a spray gun or the otherwise mishandling of the device, since the valve stem is usually formed of tungsten carbide, or other material of suitable high erosion resistance, it is very brittle and easily broken when the sudden shock of an impact is applied to it. Thus, it was found that when such a shock was applied to the adjustment knob of the spray tip, as when it was inadvertently dropped, and thereby transmitted to the valve stem, the valve stem almost invariably was broken.

Another problem encountered with this design related to the difficulty of removing broken valve stems from the spray tip. Often times after operation of the spray tip with such materials as an epoxy paint, if the tip was not adequately cleaned, a residue of paint would remain on the valve stem and become very hard upon drying. Thus, when the valve was subsequently adjusted by the operator the possibility of breaking the valve stem in the valve bore was great and with the caked residue on the stem it was almost impossible to remove from the spray tip. Thus, unless the residue on the broken stem could be disolved by solvents, it was necessary to replace the spray tip with a new or undamaged one.

Yet another problem with this previous design, and which in fact affects many other conventional spray tips, is the appearance of "tails" in the resulting spray pattern. "Tails", as the term is used by those skilled in the art, refers to the appearance at each corner of the spray fan and slightly separated therefrom of substantially smaller segments of the spray.

Although these problems are not too significant, they are also not insignificant and it is, therefore, a primary object of the present invention to improve the adjustable spray tip described above in order to eliminate or at least alleviate the problems described.

This object, as well as others which will hereinafter become apparent, is accomplished in accordance with the present invention by the making of certain improvements in the valve stem, the valve bore, and the fluid bore of the adjustable spray tip above described. In order to eliminate or alleviate the problem of broken valve stems resulting from dropping or mishandling of the spray tips, the valve stem has been designed to "float" freely with respect to the adjustment means therefor, thereby significantly insulating the valve stem from the transmittal of shocks due to impact to the adjustment knob. In addition, I have discovered that a weakening of the valve stem shank, which is formed of a less brittle material, is helpful in this respect since the shank portion will bend as the result of a bending force before the more brittle stem is broken. With respect to the removal from the spray tip of broken valve stems, means are provided whereby a broken valve stem may be dislodged from the valve bore in most cases. The elimination of "tails" from the spray fan and resulting spray pattern is accomplished by providing means whereby the velocity of the fluid impinging on the nozzle opening is substantially more uniform than in the previous design.

The present invention will be described and understood more readily when considered together with the embodiment shown in the accompanying drawings, in which.

Figure 1:
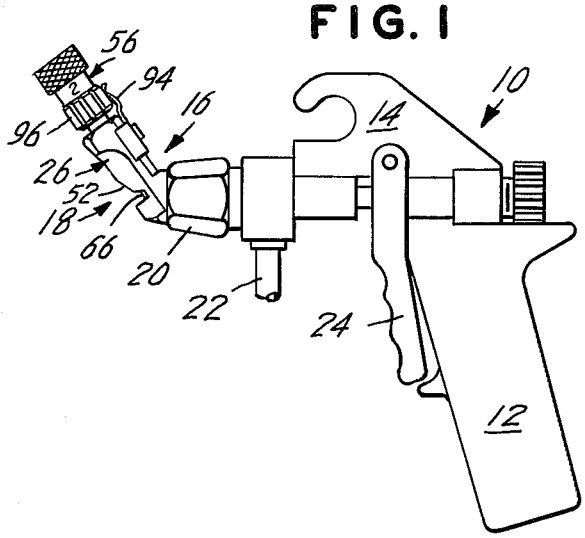
FIG. 1 is a side elevational view of a hydraulic spray gun having attached thereto a spray tip according to the present invention.

Referring now to the drawings, there is shown in FIG. 1 a spray gun, generally designated 10, adapted for hydraulically atomizing and spraying liquids such as paint. It is to be appreciated that the present invention may be utilized with spray devices other than spray guns adapted for spraying paint. Spray gun 10 comprises a handle portion 12, a body portion 14, and a spray portion 16. Spray portion 16 includes spray tip 18 secured to body portion 14 by retaining nut 20, conduit 22 communicating with a reservoir of paint (not shown) maintained under high pressure and an actuating valve (not shown) housed within body portion 14. The actuating valve housed within body portion 14 is activated by the operator by depressing trigger mechanism 24 to thereby deliver paint under high pressure from conduit 22 to spray tip 18.

Figure 2:
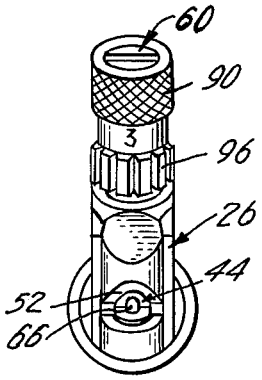
FIG. 2 is an enlarged front elevational view of the spray tip of FIG. 1.
Figure 4:
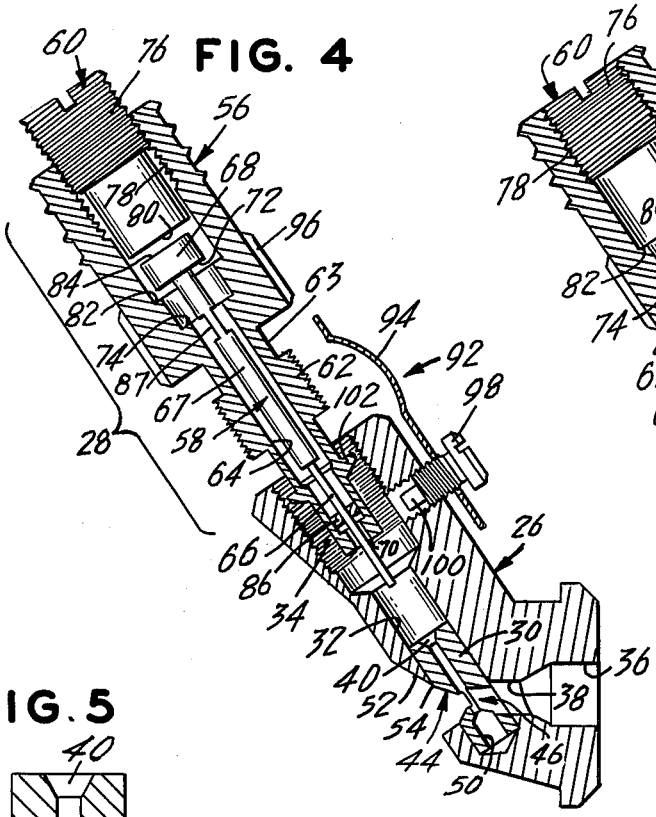
FIG. 4 is a partially exploded view of the spray tip of the present invention shown in FIG. 3.
Figure 3:
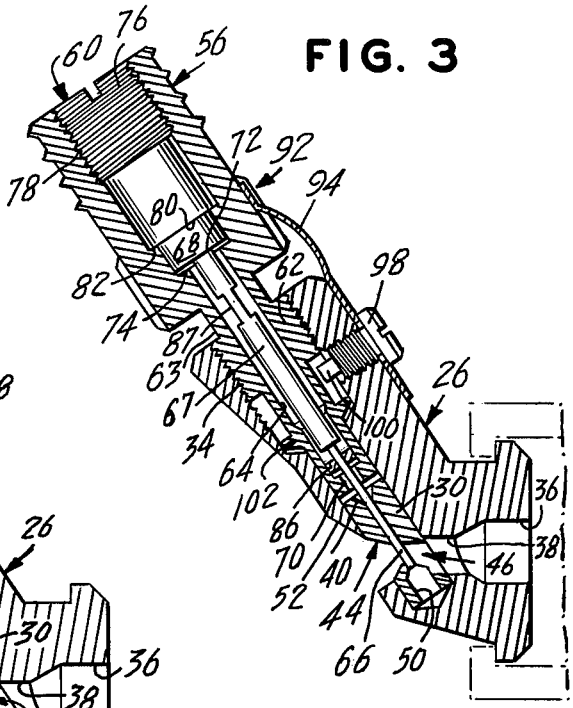
FIG. 3 is an enlarged cross-sectional view of the spray tip according to the present invention.

Spray tip 18 of the present invention is clearly depicted in FIGS. 2, 3 and 4 and includes a spray tip housing, generally designated 26, a valve adjustment assembly designated 28, and valve housing 30. Spray tip housing 26 is provided with a bore, generally designated 32, adapted to accept valve housing 30 which may be press fitted therein. Coaxially aligned and communicating with bore 32 is threaded bore 34 which is adapted to accept valve adjustment assembly 28. Housing 26 is also provided with a fluid bore, generally designated 36, which at its upstream end communicates with the bore (not shown) in body portion 14 of spray gun 10 which houses the actuating valve. When the actuating valve is activated, liquid paint under high pressure is supplied to fluid bore 36. At its downstream end, fluid bore 36 is restricted at 38 to thereby increase the fluid velocity of the high pressure liquid paint passing therethrough and it also intersects bore 32.

Figure 5:
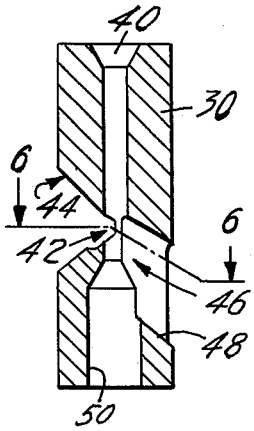
FIG. 5 is an enlarged cross-sectional view of a portion of the spray tip of the present invention.

Valve housing 30 is provided with a centrally located valve bore, generally designated 40, having a spray opening, designated 42, formed by providing groove 44 in housing 30. Opposite spray opening 42 is elongated opening 46 formed in bore 40 by the provision of slotted bore 48 in valve housing 30. Below spray opening 42, as clearly seen in FIG. 5, valve bore 40 is provided with an expanded bore 50, the function of which will be more fully explained hereinafter. Elongated opening 46 is so dimensioned as to encompass all of spray opening 42 and also a part of expanded bore 50 of valve bore 40. As clearly seen in FIGS. 3 and 4, valve housing 30 is positioned within bore 32 so that bore 48 thereof is encompassed by the restricted portion 38 of fluid bore 36 within spray tip housing 26. A groove, generally designated 52, is provided in housing 26 so as to intersect bore 32 at opening 54, said opening 54 coinciding with groove 44 of valve housing 30.

Valve adjustment assembly 28 as clearly seen in FIGS. 3 and 4, basically comprises assembly housing 56, valve stem assembly 58 and valve stem assembly retainer 60. Assembly housing 56 is provided with a threaded portion 62 which is mateable with the threaded portion 34 of spray tip housing 26 whereby threadable engagement and adjustment of valve adjustment assembly 28 is permitted. Above threaded portion 62 of housing 56 a weakened area, designated 63, is provided for the purpose of allowing housing 56 to bend or deflect at this point before the more brittle valve housing 30 can be damaged. Assembly housing 56 is also provided with a centrally disposed bore, passing therethrough, generally designated 64, which houses valve stem assembly 58 which itself is retained therein by means of valve stem assembly retainer 60. Valve stem assembly 58 includes valve stem 66, shank 67 and retaining head 68 attached thereto. Valve stem 66, which is formed of tungsten carbide, is provided with a shank 67 which itself may be formed of a less brittle material such as brass. The valve stem may be attached to the shank by any means such as pressed in, welded, etc. Stem 66 extends through restricted opening 70 at the base of housing 56 and well into bore 40 of valve housing 30. Retaining head 68 is provided with shoulder 72 which contacts with mating shoulder 74 in bore 64 of assembly housing 56 when valve stem assembly 58 is positioned therein. Valve stem assembly retainer 60 serves to retain valve stem assembly 58 within bore 64 of assembly housing 56. This may be accomplished by providing mateable screw threads on retainer 60, designated 76, and on bore 64, designated 78. The base 80 of retainer 60 abuts against shoulder 82 within bore 64 in such a manner as to allow a very slight clearance with the upper part 84 of retaining head 68. A resilient washer 86 in bore 64 serves as a seal to prevent paint from entering the area of bore 64, hardening and thereby interfering with the operation of valve stem assembly 58. The desired effect of this arrangement is to permit valve stem 66 to "float" with respect to assembly housing 56 as clearly seen in FIG. 3.

Shank 67 of valve stem assembly 58 is provided with an undercut portion, designated 87, which, as clearly seen in FIG. 3, is aligned with weakened area 63 so that in the event spray tip 18 is dropped on valve adjustment assembly 28, housing 56 will bend at weakened area 63 without damaging valve housing 30 and shank 67 will bend at undercut 87 without breaking or damaging valve stem 66.

Figure 6:
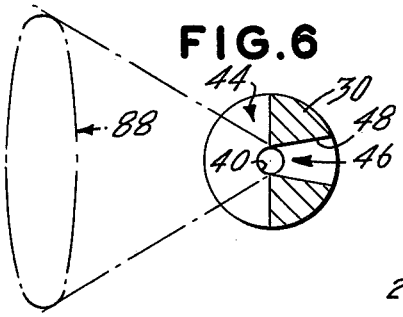
FIG. 6 is a cross-sectional view of a portion of the spray tip shown in FIG. 5 taken along line 6—6 of FIG. 5 together with a depiction of the spray issuing from the spray tip of the present invention.
Figure 7:
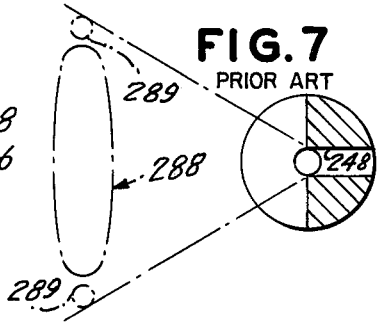
FIG. 7 PRIOR ART
FIG.7 is a view similar to that shown in FIG. 6 of the portion of the spray tip of the earlier design with a depiction of the spray issuing from that spray tip.

As clearly seen in FIG. 6, slotted bore 48 is formed so as to have a decreasingly tapered side wall toward bore 40 whereas in the prior design of FIG. 7, bore 248 is provided with straight walls. It is believed that the effect of thus tapering the sidewalls of bore 48 is to eliminate the "tails", designated 289 in FIG. 7, from the spray pattern 288. It is believed that what occurs in the design of FIG. 6 is that the velocity of the high pressure fluid passing through bore 48 is increased at the side walls thereof in accordance with the laws of fluid flow so that as the fluid leaves spray opening 42 it does so at a more uniform velocity resulting in a spray pattern such as pattern 88. In the previous design, illustrated by FIG. 7, the fluid velocity at the side walls of bore 248, following the laws of fluid flow, would approach zero and it is believed that the portions of the spray defined thereby tended to be separated from the main body of the spray and thus form "tails". It is also believed that the provision of expanded bore 50 below spray opening 42 is helpful in eliminating "tails" from the resulting spray pattern.

In order to adjust the positioning of valve stem 66 within bore 40 of valve housing 30, valve adjustment assembly 28 is screwed in or out of spray tip housing 26 by the operator gripping and turning knurled portion 90 of assembly 28. A ratchet mechanism, designated 92, which may comprise a spring clip 94 engageable with grooved portion 96 of valve adjustment assembly 28, serves to prevent the inadvertent or accidental adjustment or movement of valve stem 66. Spring clip 94 may be secured to spray tip housing 26 by means of screw 98. In order to prevent valve adjustment assembly 28 from being inadvertently withdrawn from spray tip housing 26, a stem, designated 100, may be provided on the end of screw 98 which extends into bore 32 and together with stop 102 on assembly prevents the withdrawal thereof.

In operation, liquid under high pressure is delivered to spray tip 18 when the operator depresses trigger mechanism 24 whereby the fluid in conduit 22 is transferred to fluid bore 36 of spray tip housing 26. Depending on the positioning of the valve adjustment assembly 28 by the operator, a spray will issue from spray opening 42 which may be varied by the operator by screwing assembly 28 in or out with respect to spray tip housing 26. This adjustment by the operator moves valve stem 66 in valve bore 40 of valve housing 30. It has been found that for best performance valve bore 40, and hence valve stem 66, would be inclined or angularly positioned with respect to the desired axis of the spray leaving spray opening 42. In the event that for some inadvertent reason spray gun 10 or spray tip 18 is dropped by the operator, the shock which would normally be felt by valve stem 66 would not be, since valve stem assembly 58 "floats" with respect to valve stem assembly housing 56. Thus, since valve stem 66 is formed of tungsten carbide and would normally break when subjected to such a shock, since it is substantially insulated from shocks according to the present design, it would normally not break. In addition, since assembly housing 56 as well as shank 67 are weakened at 63 and 87 respe respectively, if a severe shock is applied to valve adjustment assembly 28 it would be absorbed by the assembly housing and shank prior to damaging valve housing 30 or valve stem 66. Furthermore, in those rare instances when valve stem 66 does break, and the broken part is difficult to remove, a sharp instrument may be inserted through fluid bore 36 and into expanded bore 50 to thereby pry the broken stem loose from valve bore 30. Obviously, a new and unbroken valve stem assembly 58 can be positioned in assembly housing 56 once retainer 60 has been removed therefrom and the broken valve stem assembly discarded.

It is to be understood that the foregoing general and detailed descriptions are explanatory of the present invention and are not to be interpreted as restrictive of the scope of the following claims.

What is claimed is:

1. An adjustable spray nozzle for use with a spray gun, said spray gun being adapted for hydraulically atomizing and spraying liquids and including conduit means communicating with a source of liquid under pressure, said adjustable spray nozzle comprising:

(a) a spray tip housing including means for securing said housing to said spray gun;

(b) a fluid bore in said housing communicating with said conduit means and terminating in a spray opening in said housing;

(c) a valve bore in said housing intersecting said fluid bore adjacent said spray opening;

(d) a valve stem including a shank portion adapted for adjustable movement in said valve bore to thereby vary said spray opening;

(e) means for adjustably moving said stem in said valve bore externally of said spray tip housing; and (f) means providing floating engagement of said valve stem with said adjustment means.

2. The adjustable spray nozzle of claim 1 wherein the means providing floating engagement of the valve stem with the adjustment means comprises providing the shank portion of said valve stem with an enlarged portion which is loosely engaged by said adjustment means.

3. The adjustable spray nozzle of claim 1 wherein the adjustment means for the valve stem includes a weakened portion externally of and adjacent to said spray tip housing.

4. The adjustable spray nozzle of claim 3 wherein the shank portion of said valve stem includes a weakened portion which corresponds to the weakened portion of said adjustment means.

5. The adjustable spray nozzle of claim 1 wherein the valve bore includes an expanded portion beyond the intersection thereof with said fluid bore.

6. The adjustable spray nozzle of claim 1 wherein the fluid bore is provided with decreasingly tapering sidewalls adjacent to said spray opening.

7. In an adjustable spray nozzle of the type used with a spray gun or the like adapted for hydraulically atomizing and spraying liquids, the spray gun having conduit means communicating with a source of liquid under pressure, the spray nozzle including a housing securable to said spray gun, a fluid bore in said housing communicating with said conduit means and terminating in a spray opening, a valve bore in said housing intersecting said fluid bore adjacent said spray opening, a valve stem including a shank portion adapted for adjustable movement in said valve bore to thereby vary the spray opening, and means externally of said spray tip housing for adjustably moving said stem in said valve bore, the improvement comprising means providing floating engagement of said valve stem with said adjustment means.

8. The adjustable spray nozzle as defined in claim 7 wherein the means providing floating engagement of said valve stem with said adjustment means comprises providing the shank portion of said valve stem with an enlarged portion which is loosely engaged by said adjustment means.

9. The adjustable spray nozzle is defined in claim 7 wherein the improvement further comprises providing a weakened portion in the adjustment means for said valve stem externally of and adjacent to said spray tip housing.

10. The adjustable spray nozzle as defined in claim 9 wherein the improvement further comprises providing a weakened portion in the shank portion of said valve stem corresponding to the weakened portion of said adjustment means.

11. The adjustable spray nozzle as defined in claim 7 wherein the improvement further comprises providing said valve bore with an expanded portion beyond the intersection thereof with said fluid bore.

12. The adjustable spray nozzle as defined in claim 7 wherein the improvement further comprises providing said fluid bore with decreasingly tapering sidewalls adjacent to said spray opening.

* * * * *